198-484.4 $$$ SR
10/22/85 XR 4,548,244

United States Patent [19]
Risko et al.

[11] Patent Number: 4,548,244
[45] Date of Patent: Oct. 22, 1985

[54] ELECTRONIC PROGRAM CONTROL

[75] Inventors: Frank D. Risko, Livonia; Thomas D. Lewis, Highland, both of Mich.

[73] Assignee: Ex-Cell-O Corporation, Troy, Mich.

[21] Appl. No.: 676,361

[22] Filed: Nov. 29, 1984

[51] Int. Cl.[4] ..... B65B 57/02
[52] U.S. Cl. ..... 141/156; 53/67; 198/464.4
[58] Field of Search ..... 53/67, 69, 70, 72, 494, 53/506; 141/155, 156; 198/468

[56] References Cited

U.S. PATENT DOCUMENTS 4,172,347 10/1979 Nitz ..... 53/505 X
4,456,118 6/1984 Kauffman et al. ..... 53/565 X

*Primary Examiner*—Stephen Marcus
*Assistant Examiner*—Mark Thronson
*Attorney, Agent, or Firm*—John P. Moran

[57] ABSTRACT

This disclosure illustrates and describes an electronic program control for controlling the filling operation for cartons supplied by one turret mechanism having a plurality of equally spaced mandrels to a compartmented conveyor which carries the cartons in pairs beneath a pair of filler nozzles. The electronic program control includes the switches, AND gates, shift registers and flip flops required to assure that, in the event a carton is missing for any reason from a conveyor compartment, the appropriate filler nozzle will not be actuated.

10 Claims, 7 Drawing Figures

ELECTRONIC PROGRAM CONTROL

TECHNICAL FIELD

This invention relates generally to the electronic control art and, more particularly, to a novel electronic control system for controlling a sequence of operations on products moving on an indexing conveyor, such as the operations involved in forming, filling and sealing containers as they are conveyed along a packaging machine.

BACKGROUND ART

Heretofore, the procedure for detecting a carton on a typical packaging machine has occurred on the conveyor chain, just prior to the fill station, by microswitches operated by lever arms. The location of such switches and lever arms is in a high moisture area and such that they are very difficult to clean. A switch and lever arm are associated with each filler nozzle and if no carton is detected, a fill cycle will not occur for that particular nozzle. This is important because a carton may misfeed and, hence, not be inserted on the mandrel, resulting in an open carton slot in the conveyor. Therefore, a no-product/no-fill cycle should occur. A satisfactory electronic program control system is shown and described in U.S. Pat. No. 4,172,347, issued on Oct. 30, 1979, for filling individual containers in four equal portions as each progressively passes beneath four filler heads.

DISCLOSURE OF INVENTION

A general object of this invention is to provide improved means for detecting the presence of a carton on a liquid packaging machine, and sequentially indexing a shift register to equal the number of stations between the point of carton detection and the filler nozzles so that correct filling of each carton will occur at the appropriate time in the forming, filling and sealing cycle.

Another object of the invention is to provide improved carton detecting means at the mandrel loading station, for cooperation with shift register means for assuring a correct filling procedure.

A further object of the invention is to provide a single detector unit for detecting the presence of a carton at the mandrel loading station of a double indexing type forming, filling and sealing machine, wherein the mandrel indexing speed is twice the indexing speed of the conveyor so that two cartons are inserted onto the conveyor chain for each index of the latter, and associated electronic means for assuring that the presence or absence of a carton is transmitted to either of dual filler units for filling or not filling at the proper time.

These and other objects and advantages of the invention will be apparent when reference is made to the following description and accompanying drawings.

BEST MODE OF CARRYING OUT THE INVENTION

Figures 1, 3, 3A, 3B:
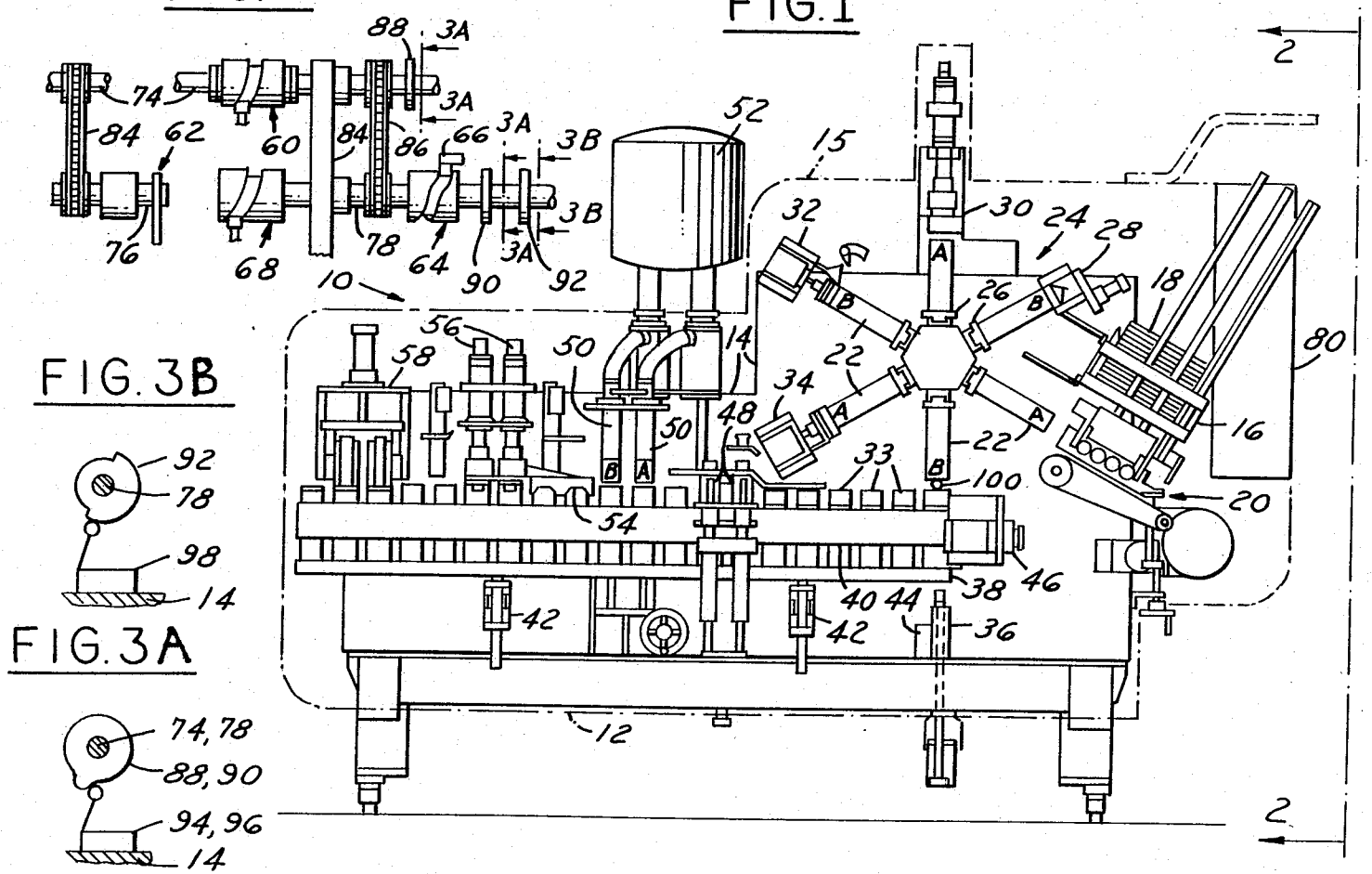
FIG. 1 is a side elevational view of a forming, filling and sealing machine embodying the invention.
FIG. 3 is a fragmentary side elevational view of the control or drive side of the machine opposite the FIG. 1 view.
FIGS. 3A and 3B are schematic representations of selected portions of the FIG. 3 structure taken along the plane of the respective lines 3A—3A and 3B—3B.
Figure 2:
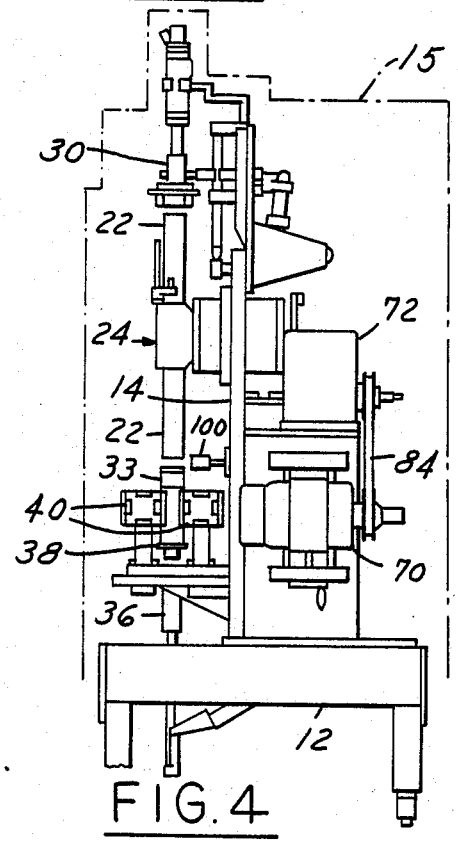
FIG. 2 is an end view of the FIG. 1 machine taken along the plane of the line 2—2, and looking in the direction of the arrows.

Referring now to the drawings in greater detail, FIG. 1 illustrates a forming, filling and sealing machine 10 of the liquid packaging type, including a base frame 12, and a vertical support keel 14 mounted along the longitudinal axis of the frame. The frame and keel are best shown in FIG. 2, within a suitable enclosure, represented at 15. The loading, forming, filling and sealing components are mounted on one side of the keel 14 as follows:

A magazine 16 for holding a plurality of paperboard blanks 18 is mounted on the one side of one end of the keel. A loading mechanism 20 is mounted on the keel just below the magazine 16 and adapted to withdraw one side-seamed flat blank at a time from the magazine while opening same into a foursided tube and then to load such individual tube onto one of six mandrels 22 of an indexable turret mechanism 24. The latter is rotatably mounted on an upper portion of the keel 14. The receiving mandrel is positioned at 4:00 o'clock when a paperboard tube is slid thereon by the loading mechanism 20. An adjustable stop member 26 is operatively connected to each mandrel 22 to accommodate the forming of cartons having the same cross-section but different heights.

The mandrel indexes counterclockwise in FIG. 1 to a 2:00 o'clock position where two of the usual four bottom closure panels of the tube are pre-broken along preformed score lines by a pre-breaker unit 28. At the 12:00 o'clock position, the four bottom closure panels are heated by a suitable heater 30 operatively mounted on the keel 14 above the 12:00 o'clock mandrel. The bottom heated tube and mandrel 22 are next indexed to a 10:00 o'clock position where a closing and sealing unit 32 closes the bottom panels into an overlapped flat configuration, and under pressure, seals the overlapped panels together, changing the tube into a bottom sealed container or carton 33 suitable for containing a liquid. Thereafter the bottom sealed carton is indexed to an 8:00 o'clock position where it continues to cool, but which may include a second sealing unit 40, prior to being indexed to an unloading 6:00 o'clock position.

At the latter position, the carton is stripped from the mandrel 22 by a stripping unit 36 and pulled downwardly to rest on a stationary rail 38 extending laterally from between a pair of parallel endless conveyors 40 during its dwell period. As may be noted in FIG. 1, the rail 38 is supported on brackets 42 mounted on one side of the keel 14. The stripping unit 36 is also mounted on the keel 14, supported thereon by a bracket 44. As the conveyors index leftward in FIG. 1, the rotation of the turret mechanism 24 is coordinated with the movement of the conveyors so as to continuously supply bottom sealed cartons 33 at regular intervals, ready for transfer to the conveyors in the following manner and operational sequence.

With the carton 33 thus seated on the rail 38, it is in position to be transferred. During the dwell period of the conveyors 40, a transfer pusher 46 moves the first bottom-formed carton leftward in FIG. 1, along the rail 38 between suitable guides, into position in a pocket formed by lugs (not shown) on the conveyors 40, after which the pusher 46 retracts. During the transfer period, the next mandrel 22 of the turret 24 indexes to the 6:00 o'clock position where the next carton is stripped from the mandrel by the stripping mechanism 36 and deposited on the rail 38, in position to be transferred. As the conveyors begin their indexing cycle, the first carton is advanced. While the indexing cycle of the conveyors 40 is in process, the pusher 46 moves this newest carton horizontally along the rail 38 into the entrance to the parallel conveyors 40 behind the now moving first carton, to be engaged by lugs (not shown) at the moving ends of the conveyors. In this instance, the pusher 46 is adapted to move a predetermined distance farther than it did for the preceding carton, in order to help assure that the carton keeps up with the moving conveyors until engaged thereby. Once again the pusher 46 retracts, ready for the next cycle of delivering two cartons from the turret 24 for each one index of the conveyors 40. The details of the single-to-dual-carton transfer means is shown and described in U.S. Pat. No. 4,456,118, incorporated herein by reference.

After a predetermined number of indexes of the conveyors 40, each succeeding pair of cartons is positioned beneath a pair of top pre-breaker units 48 where the two oppositely disposed top panels of each carton 33 are pre-broken along preformed respective conventional gable-shaped infold score lines. A pair of cartons is thereafter indexed into position beneath a pair of filling nozzles 50, each of which feeds a measured volume of a particular liquid, such as milk or juice, from a source 52 into the cartons. As the cartons 33 index in pairs therefrom, their top panels are folded, heated, and sealed by respective folding, heating, and sealing units 54, 56 and 58 mounted on the keel 14. Thereafter, at the end of the forward travel of the endless conveyors 40, the closed cartons are discharged onto any suitable track unit (not shown) to be readied for shipment.

It should be realized that sealing units could be utilized, suitable for folding the carton top panels into a flat top closure for particular applications, after passing the filling nozzles 50.

Insofar as the drive units shown in FIG. 3 are concerned for coordinating the above sequence of operations, a first indexing cam unit 60 controls the operation of the indexable turret mechanism 24 (FIG. 1), a cam or suitable crank 62 controls the operation of the stripping unit 36, a second indexing cam unit 64 and suitable linkage 66 controls the operation of the pusher 46, and a third indexing cam unit 68 controls the operation of the conveyor 40, all of which are coordinated for constant timing by virtue of being driven by one electric motor 70 (FIG. 2), worm gear drive unit 72 (FIG. 2), drive shaft 74, and driven shafts 76 and 78, in conjunction with a suitable control box 80 (FIG. 1). The shafts 74, 76 and 78 are supported in openings formed through a wall 84 extending transversely from the keel 14. Chains 84 and 86 interconnect the shafts 76 and 78 with the drive shaft 74. The indexing cam unit 60 is mounted on the drive shaft 74, the crank 62 is connected to the driven shaft 76, and the cam 64 and indexing cam unit 68 are both mounted on the driven shaft 78. A cam 88 of the type shown in FIG. 3B is mounted on the drive shaft 74. A similar shaped cam 90 is mounted on the driven shaft 78. A cam 92 of the type shown in FIG. 3A is also mounted on the driven shaft 78. Suitable limit switches 94, 96 and 98 are mounted on the keel 14 and operatively connected to the cams 88, 90 and 92, respectively.

In operation, the turret 24 is caused to index twice for each index of the conveyors 40, and the stripping unit 36 is actuated in conjunction with each index of the turret. The conveyors 40 are caused to index once for each two indexes of the turret, receiving one carton while dwelling and a second carton while indexing. The pusher 46 is coordinated with the operation of the stripping unit 36 to push one carton into position between suitable lugs (not shown) on the conveyors 40 during the conveyors' dwell period, and to alternately push the second carton into position between the next set of lugs thereon during the conveyors' indexing step.

A carton detector switch 100 (FIG. 1), which may be a proximity or photo-optical switch, is preferably mounted on the keel 14 so as to be operative just below the end of the mandrel 22 in the 6:00 o'clock position (FIG. 1). If desired, the switch 100 could alternatively be located at the 4:00 o'clock carton loading or receiving mandrel position adjacent the distal end of a mandrel 22, or intermediate the 4:00 o'clock position and the 2:00 o'clock pre-breaker station, thereby detecting the presence of the paperboard tube while the mandrel is moving, and compensating for the required small change in the timing cycle.

Figure 4:
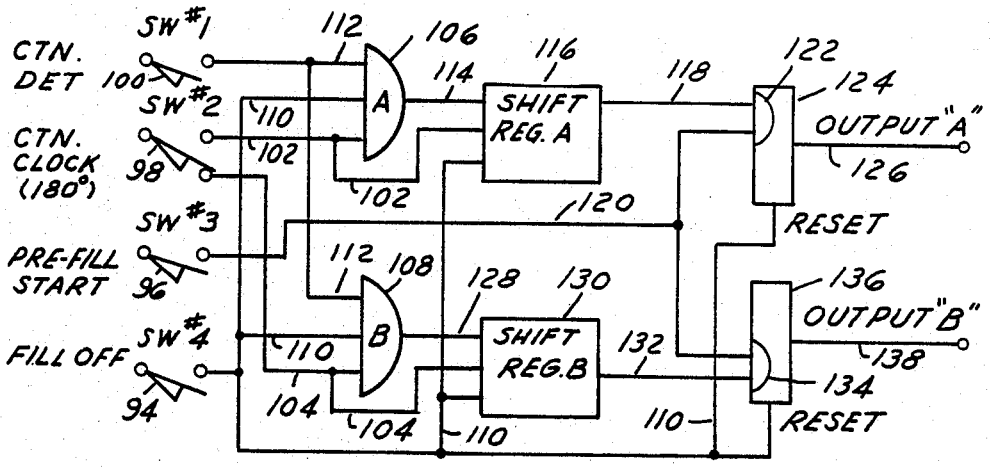
FIG. 4 is a logic diagram of the invention.

The operation of the electronic control system will now be described for a detection operation occurring at the 6:00 o'clock carton stripping station, with reference to the FIG. 4 logic diagram and the FIG. 5 timing chart. The limit switch 98, which will hereinafter be referred to as a carton clock switch, is, by virtue of its operative relationship to the cam 92 on the driven shaft 78, timed at 180° out of phase so that appropriate carton clock A 102' and carton clock B 104' signals on input lines 102 and 104, respectively, shown in FIGS. 4 and 5, will be sent to AND gates 106 and 108 at alternate dwell times of the drive shaft 74 and, hence, of the turret mechanism 24. The mandrels 22 are alternately labeled "A" and "B" in FIG. 1. The switch 94, which will hereinafter be referred to as a fill-off switch, develops tach signal 110' which will strobe or signal the respective AND gates 106 and 108 on each revolution of the drive shaft 74 due to its operative relationship to the cam 88 on the drive shaft 74, such signals being represented as 110' in FIG. 5. The carton detector switch 100 develops a carton detector signal 112', on an input line 112, shown in FIGS. 5 and 4, respectively, upon removal of each carton from the 6:00 o'clock manual (FIG. 1). Alternate signals on the line 112 are also represented as A and B in FIG. 5, corresponding to alternate mandrels A and B and successive filling nozzles 50.

When all three input signals 102', 110' and 112' on input lines 102, 110 and 112, respectively, are sensed by the AND gate 106, an output is presented to input line 114 of a shift register 116. Receipt of the signal on the line 114, in conjunction with the signal 102' from the carton clock switch 98 and the signal 110' from the fill-off switch 94, actuates the shift register 116 by one count, the shift register 116 being preset to count an appropriate number of cycles, in this case five cycles, to set up the energization of a pre-fill cycle. The pre-fill cycle is timed to start when the output signal presented on a line 118 in FIG. 4, of the shift register 116 and a strobe signal 120', from the pre-fill start switch 96, actuated by the cam 90, occur simultaneously at the input to an AND gate 122 of an output holding circuit, known as a "flip flop" 124, producing an output signal 126' on a line 126, to the filling circuitry for the A filler unit 50. Alternately, three input signals 104', 110' and 112' sensed by the AND gate 108 will produce an output signal on a line 128 which, in conjunction with the signal 104' from the carton clock switch 98, and the signal 110' from the fill-off switch 94, actuates a second shift register 130 which is pre-set to count an appropriate number of cycles, in this case six cycles, to set up the energization of another pre-fill cycle. This cycle is timed to start when the output, represented on a line 132 in FIG. 4, of the shift register 130, and the strobe signal 120' from the pre-fill start switch 96 occur simultaneously at the input to an AND gate 134 of a flip flop 136, producing an output signal 138' on a line 138, to the filling circuitry for the B filler unit 50. The respective pre-fill operations for the nozzles 50 occur one station before the filler station, because the product must be pre-measured during one part of the fill cycle, and then dispensed into each carton 33 during a second part of the fill cycle.

Figure 5:
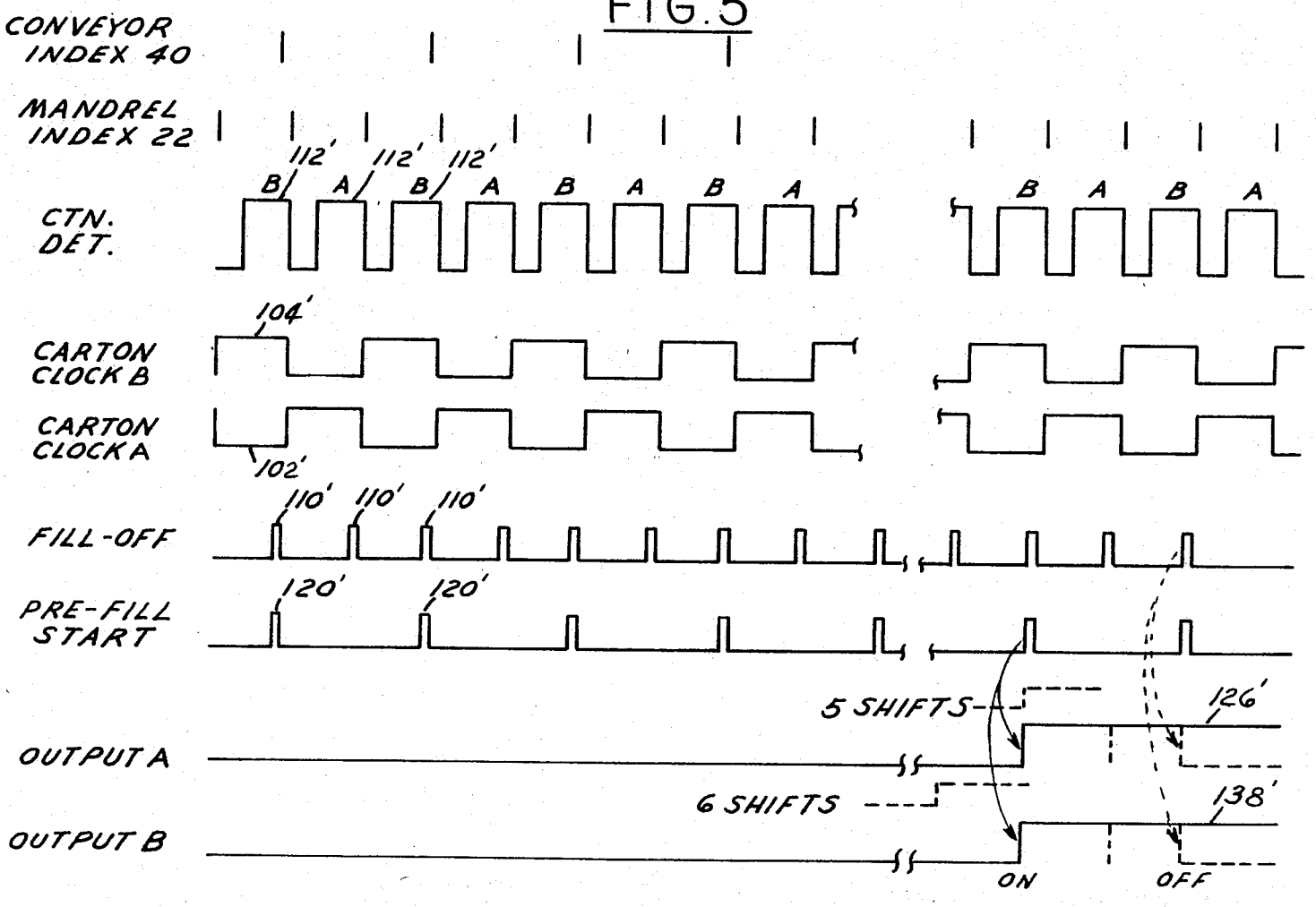
FIG. 5 is a graphic representation or chart of the timing operation of the FIG. 1 machine.

In the timing chart of FIG. 5, shifts have been indicated arbitrarily for each product output as "5" and "6" shifts, respectively, complying with the machine 10 arrangement shown in FIG. 1. Since this is a double indexing operation one nozzle 50 is always associated with a particular mandrel 22 position and is accordingly identified as "A" and "B". Hence, for a particular machine 10, there are 5 indexes for each "A" carton, and 6 indexes for each "B" carton. This could, of course, be different for other model machines, or other locations of the carton detector switch 100. Both an "A" and "B" carton can be in position to be filled and, therefore, the output state for both of them must turn on at the same time. If no additional cartons are detected at the stripper station, the output stages of both "A" and "B" would be turned off by the fill-off switch 94 signal 110', which is acting as a reset to the output stages or flip flops 124 and 136 via the line 110. If a continuous string of cartons are being fed, the outputs of the flip flops 124 and 126 ignore the reset signal 110' and serves to retain the fill solenoid energized, allowing continuous fill operation as indicated by the output signals 126' and 138' of FIG. 5. In those instances where one of either an "A" or a "B" carton is missing for any reason, it is apparent that the respective nozzles 50 will not dispense product either after the fifth or sixth index from the 6:00 o'clock carton stripper station since no signal 112' would have been given by the carton detector switch 100 in conjunction with one of the signals 102' or 104' from the carton clock switch 98. The signal 110' from the fill-off switch 94 thereafter provides a reset signal on the lines 110 to the flip flops 124 and 136, as well as at the initial start of the system, to set the outputs "A" and "B" in a deenergized state so that a fill cycle will not occur prematurely.

INDUSTRIAL APPLICABILITY

It should be apparent that the inventive program control provides an improved means for assuring that a carton is present at the filling station before the filler unit dispenses the liquid product, even where dual filler nozzles serve to fill cartons supplied by alternate mandrels of an indexable turret mechanism.

As explained, it is apparent that the carton detector unit may be selectively mounted in any one of several possible locations, even downstream of the mandrel stripping station, and that the shift registers may be selected to accommodate any number of indexes upstream of the filler nozzle or nozzles.

While but one general embodiment has been shown and described, other modifications are possible within the scope of the following claims.

The embodiments of the invention in which an exclusive property or privilege is claimed are defined as follows:

1. In an electronic program control for controlling the filling of cartons on a machine having a conveyor indexing at a particular rate and a plurality of mandrels for carrying cartons and indexing at twice the rate of the conveyor, said cartons being bottom sealed on said mandrels and transferred from successive mandrels onto the indexing conveyor so as to be indexed in aligned pairs beneath dual filler units, and the circuitry therefor, the combination comprising:

(a) a carton detection switch for detecting the passage therepast of said individual cartons and providing a signal for each;

(b) a carton clock switch for providing two signals for each index of said conveyor;

(c) a fill-off switch for providing a signal for each index of said mandrels;

(d) a pre-fill start switch for providing a signal for each index of said conveyor;

(e) first and second AND gates for providing respective signals upon receipt of simultaneous signals from each of said carton detection, carton clock, and fill-off switches;

(f) first and second shift registers for providing respective signals upon receipt of simultaneous signals from each of said respective first and second AND gates, said carton clock switch, and said fill-off switch; and (g) first and second flip flops for providing respective signals to said respective dual filler units upon receipt of simultaneous signals from each of said respective shift registers and said pre-fill start switch, for assuring that said respective filler units are operative only when a carton is indexed therebeneath.

2. The combination described in claim 1, wherein said carton detection switch is positioned at one of the mandrel loading, carton stripping, and other carton processing stations upstream of said dual filler units.

3. The combination described in claim 1, wherein said carton detection switch is positioned at the carton stripping station.

4. The combination described in claim 1, wherein said two carton clock switch signals occur during alternate dwell times of said indexing mandrels.

5. The combination described in claim 1, including drive and driven shafts in said machine, said drive shaft driving said mandrels, and said driven shaft driving said conveyor.

6. The combination described in claim 5, and a 180° out-of-phase cam mounted on said driven shaft for actuating said carton clock switch twice for each revolution of said driven shaft.

7. The combination described in claim 5, and a cam mounted on said driven shaft for actuating said pre-fill start switch once for each revolution of said driven shaft.

8. The combination described in claim 5, and a cam mounted on said drive shaft for actuating said fill-off switch once for each revolution of said drive shaft.

9. The combination described in claim 1, and an AND gate operatively connected to each flip flop.

10. The combination described in claim 1, wherein said fill-off switch signals both of said flip flops to reset same whereby filling is interrupted when a container is not beneath one of said dual filler units.

* * * * *